US006715381B2

(12) United States Patent
Junkers

(10) Patent No.: US 6,715,381 B2
(45) Date of Patent: Apr. 6, 2004

(54) ADJUSTABLE REACTION ARM FOR TORQUE POWER TOOL, AND TORQUE POWER TOOL PROVIDED THEREWITH

(76) Inventor: John K. Junkers, 8 Stonewall Rd., Saddle River, NJ (US) 07458

( * ) Notice: Subject to any disclaimer, the term of this patent is extended or adjusted under 35 U.S.C. 154(b) by 0 days.

(21) Appl. No.: 10/054,205

(22) Filed: Jan. 22, 2002

(65) Prior Publication Data

US 2003/0136229 A1 Jul. 24, 2003

(51) Int. Cl.[7] ..... B25B 13/46
(52) U.S. Cl. ..... 81/57.39; 81/57.44
(58) Field of Search ..... 81/57.39, 57.44, 81/60, 57.11, 57.26

(56) References Cited

U.S. PATENT DOCUMENTS 4,722,252 A * 2/1988 Fulcher et al. ..... 81/57.39
5,103,696 A * 4/1992 Beuke ..... 81/57.39
6,298,752 B1 * 10/2001 Junkers ..... 81/57.39
6,435,060 B1 * 8/2002 Izumisawa ..... 81/57.39
2002/0026858 A1 * 3/2002 Hu ..... 81/63.1

* cited by examiner

*Primary Examiner*—Lee D. Wilson
(74) *Attorney, Agent, or Firm*—Michael J. Striker

(57) ABSTRACT

A reaction arm is connectable to a torque power tool and has a distal portion adapted to abut against an outside object and a proximal portion connectable with a tool housing and provided with a second engaging formation formed so that in an operative position the second engaging formation engages a first engaging formation of the housing so as to hold the proximal part on the housing of the torque power tool and so that the second engaging formation can be disengaged from the first engaging formation without removal of the reaction arm from the housing for adjusting the reaction arm to different positions relative to the torque power tool and subsequently the second engaging formation can engage with the first engaging without the removal of the reaction arm from the housing to hold the reaction arm on the housing of the torque power tool in a corresponding adjusted position.

6 Claims, 4 Drawing Sheets

ADJUSTABLE REACTION ARM FOR TORQUE POWER TOOL, AND TORQUE POWER TOOL PROVIDED THEREWITH

BACKGROUND OF THE INVENTION

The present invention relates to adjustable reaction arm for torque power tools, and also to a torque power tool provided with such adjustable reaction arm.

Torque power tools require a reaction arm to abut against an adjacent stationary object, so as to stop the tool from turning around a bolt and so as to turn a nut instead. A reaction arm needs to be adjustable depending on the application, so as to give the tool a greater applicability.

On torque power tools the reaction arm is usually connected around an axis, for example a drive axis or a cylinder axis, and a mechanism is provided to hold the arm steadily relative to the tool housing. This can be done with splines, hexagons, or other configurations. When adjusting a reaction arm to another position relative to the housing, the reaction arm has to be taken off for example from the spline and put on in a different position. This causes problems within the industry as the arm might fall out of the hands of the operator. It is therefore believed to be advisable that it is important to improve the reaction arms for torque power tools.

SUMMARY OF THE INVENTION

Accordingly, it is an object of the present invention to provide a reaction arm for a torque power tool as well as a torque power tool provided therewith, which avoid the disadvantages of the prior art.

In keeping with these objects and with others which will become apparent hereinafter, one feature of present invention resides, briefly stated in a reaction arm which has a distal portion adapted to abut against an outside object and a proximal portion connectable with a housing of the torque power tool provided with first engaging means and provided with second engaging means, said second engaging means being formed so that in an operative position said second engaging means engage the first engaging means of the torque power tool so as to hold said proximal portion on the housing of the torque power tool and so that said second engaging means can be disengaged from the first engaging means of the torque power tool without removal of the reaction arm from the housing of the torque power yool for adjusting the reaction arm into different positions relative to the torque power tool and subsequently said second engaging means can be engaged with the first engaging means of the torque power tool to hold the reaction arm on the housing of the torque power tool in a corresponding adjusted position.

It is another feature of the present invention to provide a torque power tool which has a housing provided with first engaging means, and reaction arm having a distal portion adapted to abut against an outside object and a proximal portion connectable with the housing and provided with second engaging means, said second engaging means being formed so that in an operative position said second engaging means engage the first engaging means so as to hold said proximal part on the housing of the torque power tool and so that said second engaging means can be disengaged from the first engaging means without removal of the reaction arm from the housing for adjusting the reaction arm into different positions relative to the torque power tool and subsequently said second engaging means can engage with the first engaging means to hold the reaction arm on the housing of the torque power tool in a corresponding adjusted position.

When the reaction arm for a torque power tool, and a torque power tool with the reaction arm are designed in accordance with the present invention, they eliminate the advantages of the prior art.

It is no longer necessary to take the arm off the housing of the tool, and a simple rotation of the arm to its new position sufficies, while the arm still being connected to the housing.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
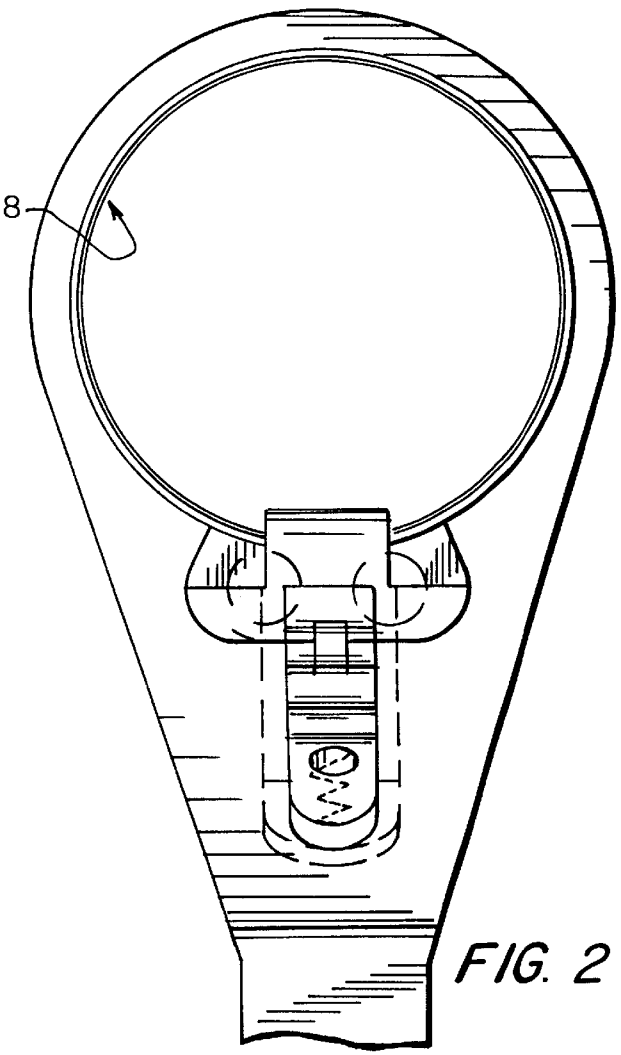
FIGS. 1 and 2 are a side view and an end view of a reaction arm for a torque power tool in a locked position, in accordance with the present invention.

A reaction arm in accordance with the present invention is identified as a whole with reference numeral 1 and is attachable to a fluid operated torque power tool which is identified as a whole with reference numeral 2. The reaction arm 1 has a distal portion 3 adapted to abut against a stationary object so as to stop the tool from turning around a bolt and to turn a nut instead, and a proximal portion 4 which is attachable to the torque power tool. As can be seen from the drawings, the torque power tool 2 has an engaging portion 5 for engaging a fastener, for example a bolt, and a drive portion 6 in which a fluid-operated drive is provided.

The torque power tool has a housing which is identified with reference numeral 7. The reaction arm 1 is attachable to the housing 7 in the region of the drive portion 6. The housing 7 for this purpose is provided with first engaging means which is identified with reference numeral 8 and can be formed as a plurality of splines distributed over an outer diameter of the housing 7 in this region. The reaction arm 1, in turn, is provided with second engaging means 9 formed in its proximal portion 4 and engageable with the first engaging means 8 of the housing 7 of the torque power tool.

The second engaging means 9 include a pawl 10 which is provided with a plurality of splines 11 corresponding to the splines 8 of the housing 7. The pawl 10 also has holes 12 for receiving compression springs 16, and a longitudinal slot 13 for receiving an end of a set screw 14. Finally, it has an access hole 15 to the set screw 14.

The reaction arm further has a user-operated locking member which is identified as a whole with reference numeral 17. The locking member 17 is formed as a slider provided with a hole 18 for a spring 19, and a hole 20 for a set screw 21 which slides in a slot 22 provided in the reaction arm 1.

Figure 1:
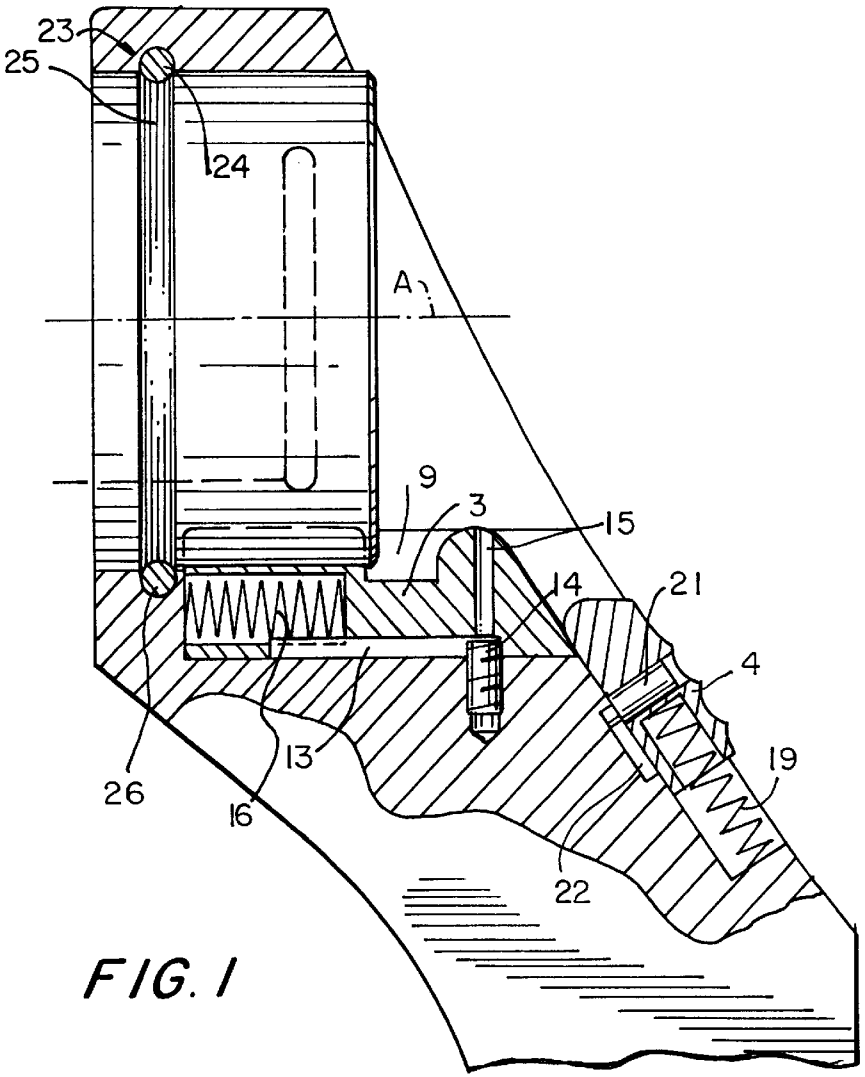
Figure 4:
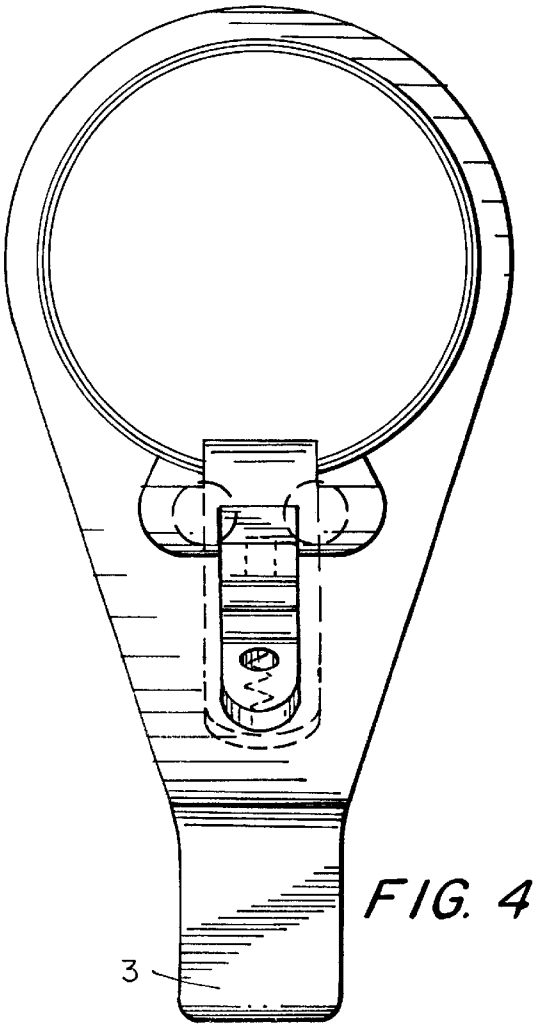
FIGS. 3 and 4 are a side view and an end view of a reaction arm for a torque power tool in an unlocked position, in accordance with the present invention.
Figure 3:
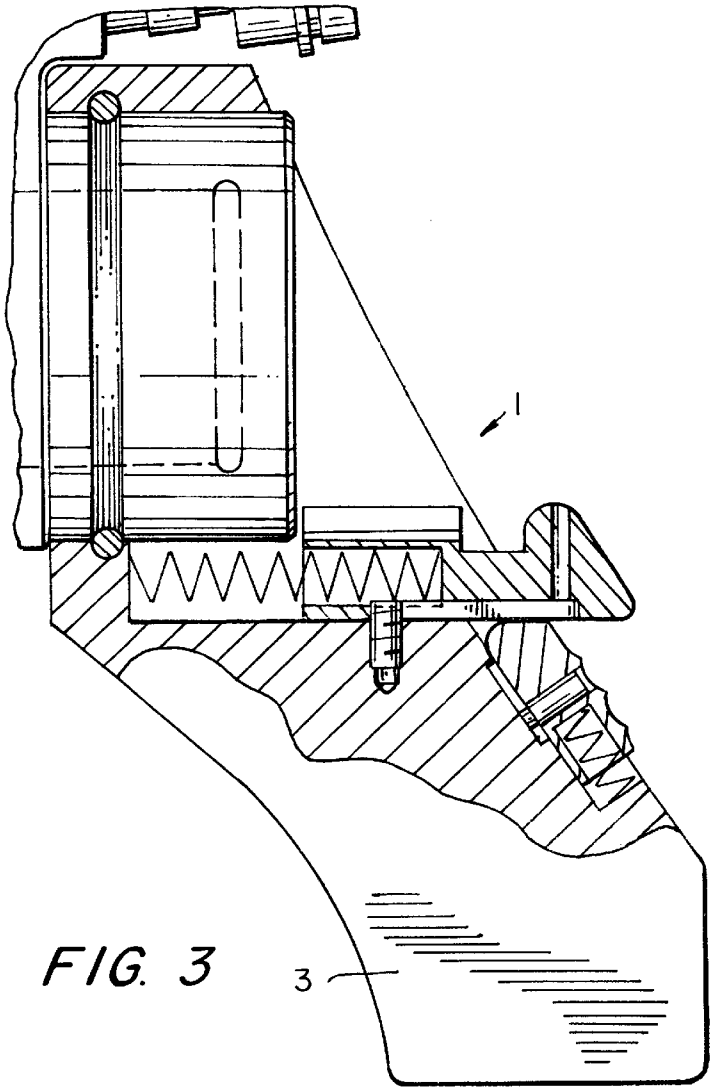
Figure 6:
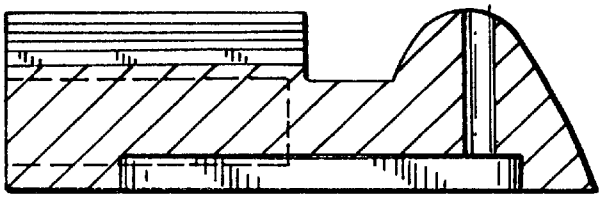
FIGS. 5, 6 and 7 are an end view, a side view and a plan view of a pawl of the inventive reaction arm.
Figure 7:
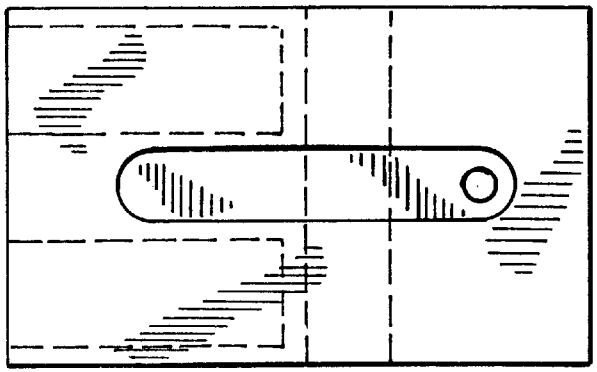
Figure 5:
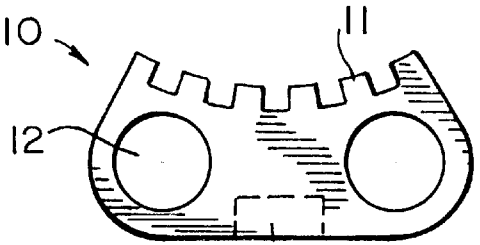
Figure 8:
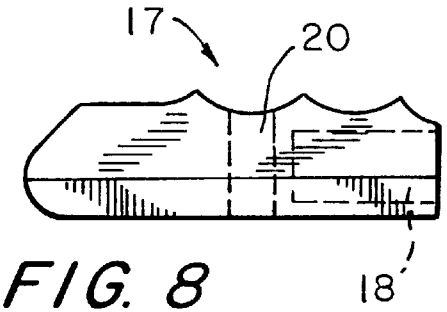
FIGS. 8 and 9 are a side view and an end view of a locking member of an inventive reaction arm.
Figure 9:
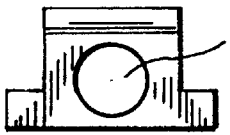
Figure 10:
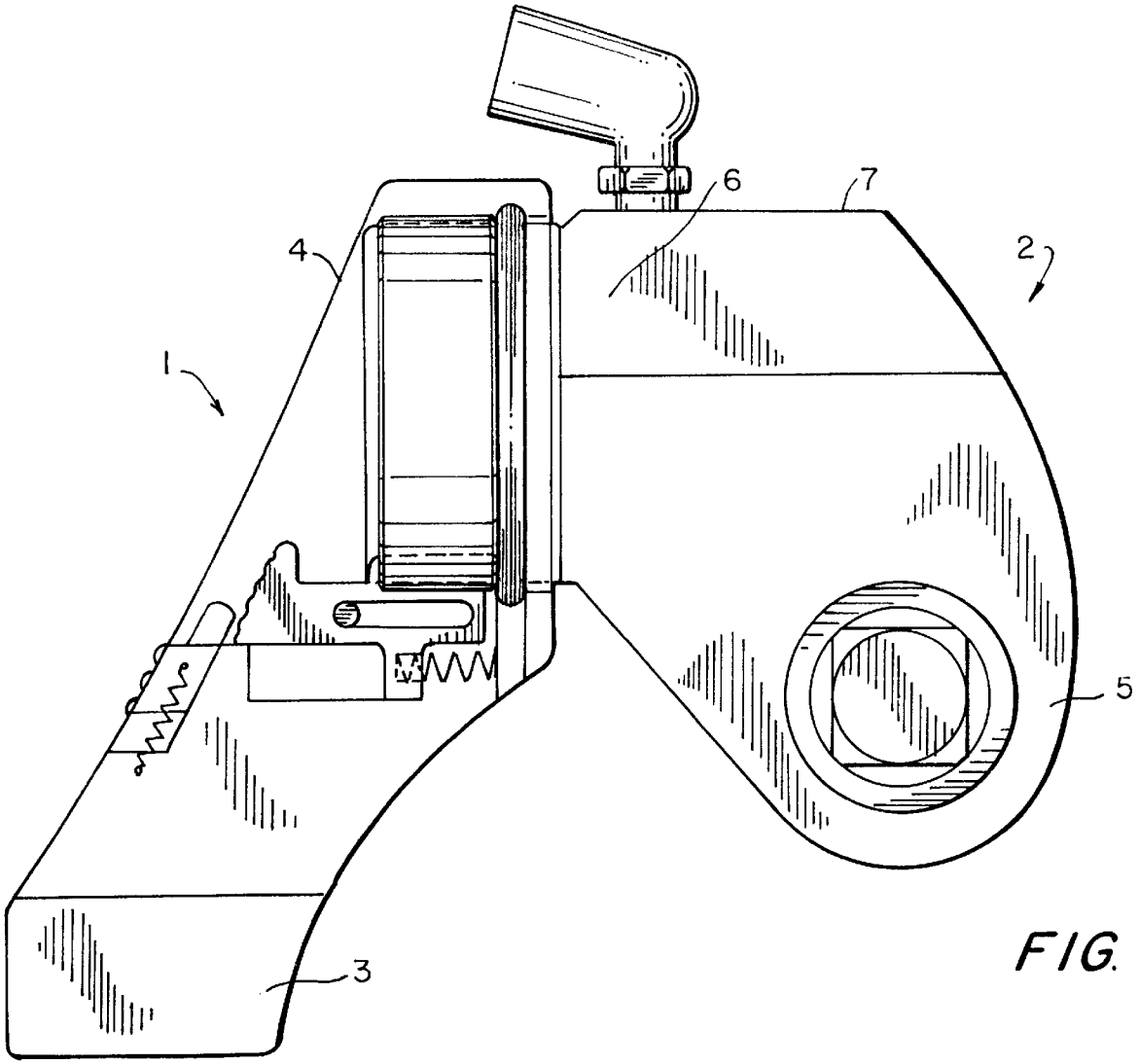
FIG. 10 is a view showing the reaction arm in accordance with the present invention attached to a torque power tool.

The reaction arm 1 for the torque power tool 2 operates in the following manner:

In the condition shown in FIGS. 1 and 2, the reaction arm 1 is mounted on the torque power tool 2 in a predetermined position. The splines 11 of the pawl 10 engage with the splines 8 of the housing 7, and the pawl 10 is locked in its position by the locking member 17 which is spring-biased from an unlocked position to the locked position by the compression spring 19. When it is necessary to adjust the reaction arm 1 to another position relative to the housing 7 of the torque power tool, the locking member 17 is pushed against the force of the compression spring 19 downwardly in the drawings beyond a path of movement of the pawl 10, and the compression spring 13 displaces the pawl 10 from the engaged position shown in FIG. 2 to a disengaged position shown in FIG. 3, so that the splines 11 of the pawl 10 are not longer engaged with the splines 8 of the housing 7 of the torque power tool. The reaction arm 1 therefore can be turned around an axis A of the drive portion of the housing 7 to a desired adjusted position, the pawl 10 is displaced by a user from the disengaged position shown in FIG. 3 back to the engaged position shown in FIG. 1, the reaction arm 1 is therefore fixed in a new adjusted position, and the spring 19 displaces the locking member 17 from the unlocked position shown in FIG. 4 to the locked position shown in FIG. 2, so that the pawl 10 can not slide back. The reaction arm is now fixed in a new adjusted position.

In order to prevent removal of the reaction arm 1 from the housing 7 of the torque power tool 2, removal preventing means is provided as identified with reference numeral 23. In the shown embodiment the removal preventing means 23 are formed by a plurality of bodies 24 which partially engage in a groove 25 provided on an outer surface of the proximal portion 6 of the housing 7, and in a groove 26 provided in the proximal portion 4 of the reaction arm 1. The bodies 24 are formed as balls, so as to form a retaining ball bearing, which simultaneously allows turning of the reaction arm on the housing 7 around the axis A and simultaneously retains the reaction arm 1 on the housing 7 from removal of the housing.

It will be understood that each of the elements described above, or two or more together, may also find a useful application in other types of constructions differing from the types described above.

While the invention has been illustrated and described as embodied in adjustable reaction arm for torque power tool, and torque power tool provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A reaction arm, connectable to a torque power tool having a housing provided with first engaging means, said reaction arm having a distal portion adapted to abut against an outside object and a proximal portion connectable with the housing of the torque power tool and provided with second engaging means, said second engaging means being formed so that in an operative position said second engaging means is engageable with the first engaging means of the housing of the torque power tool so as to hold said proximal part on the housing of the torque power tool and so that said second engaging means is disengageable from the first engaging means of the housing of the torque power tool without removal of the reaction arm from the housing of the torque power tool for adjusting the reaction arm into different positions relative to the torque power tool and subsequently said second engaging means is engageable with the first engaging means of the housing of the torque power tool without removal of the reaction arm from the housing to hold the reaction arm on the housing of the torque power tool in a corresponding adjusted position; and means for retaining said proximal portion of the reaction arm on the housing, so that the reaction arm can not be removed from the housing of the torque power tool, said retaining means including a plurality of retaining elements partially inserted in said proximal portion of the reaction arm and also partially insertable in the housing of the torque power tool.

2. The reaction are as defined in claim 1, wherein said bodies are formed as bearing bodies.

3. A torque power tool, comprising a housing having first engagement means; and a reaction arm connectable to said housing and having a distal portion adapted to abut against an outside object and a proximal portion connectable with the housing and provided with second engaging means, said second engaging means being formed so that in an operative position said second engaging means engage said first engaging means so as to hold said proximal part on said housing of the torque power tool and so that said second engaging means is disengagable from the first engaging means without removal of said reaction arm from said housing for adjusting said reaction arm to different positions relative to the torque power tool and subsequently said second engaging means is engageable with said first engaging means without removal of the reaction arm from the housing to hold said reaction arm on said housing of the torque power tool in a corresponding adjusted position; and means for retaining said proximal portion of said reaction arm on said housing, so that said reaction arm can not be removed from the housing, said retaining means including a plurality of retaining elements partially inserted in said proximal portion of the reaction arm and in said housing of the torque power tool.

4. The torque power tool as defined in claim 3, wherein said bodies are formed as bearing bodies.

5. A reaction arm, connectable to a torque power tool having a housing provided with first engaging means, said reaction arm having a distal portion adapted to abut against an outside object and a proximal portion connectable with the housing of the torque power tool and provided with second engaging means, said second engaging means being formed so that in an operative second engaging means is engageable with the first engaging means of the housing of the torque power tool so as to hold said proximal part on the housing of the torque power tool and so that said second engaging means is disengageable from the first engaging means of the housing of the torque power tool without removal of the reaction arm from the housing of the torque power tool for adjusting the reaction arm to different positions relative to the torque power tool and subsequently said second engaging means is engageable with the first engaging means of the housing of the torque power tool without removal of the reaction arm from the housing to hold the reaction arm on the housing of the torque power tool in a corresponding adjusted position, said second engaging means including at least one movable pawl which is engagable with the first engaging means of the housing of the torque power tool to hold the reaction arm in the adjusted position on the housing of the torque power tool, and movable so as to disengage from the first engaging means and thereby to allow turning the reaction arm to a new position, with a subsequent engagement of said pawl of said second engaging means with the first engaging means to retain the reaction arm in the new adjusted position without removing the reaction arm from the housing, said pawl being movable between an engaging position in which it engages with the first engaging means of the housing and a disengaging position in which said pawl is disengaged from the first engaging means; spring means which spring-bias said pawl from said engaging position to said disengaging position; and a user-operated locking element cooperating with said pawl and movable between a locked position in which said looking element locks said pawl in said engaged position, and unlocked position in which said looking element releases said pawl so that under the action of said spring means said pawl is displaced from said engaged position to said disengaged position.

6. A torque power tool, comprising a housing having first engagement means; and a reaction arm connectable to said housing and having a distal portion adapted to abut against an outside object and a proximal portion connectable with the housing and provided with second engaging means, said second engaging means being formed so that in an operative position said second engaging means engage said first engaging means so as to hold said proximal part on said housing of the torque power tool and so that said second engaging means is disengagable from the first engaging means without removal of said reaction arm from said housing for adjusting said reaction arm to different positions relative to the torque power tool and subsequently said second engaging means is engageable with said first engaging means without removal of the reaction arm from the housing to hold said reaction arm on said housing of the torque power tool in a corresponding adjusted position, said second engaging means including at least one movable pawl which is engagable with said first engaging means of said housing to hold said reaction arm in adjusted position on the torque power tool, and movable so as to disengage from said first engaging means and thereby to allow turning said reaction arm to a new position, with a subsequent engagement of said pawl of said second engaging means with said first engaging means to retain said reaction arm in the new adjusted position without removing said reaction arm from the housing, said pawl being movable between an engaging position in which it engages with said first engaging means of said housing and disengaging position in which said pawl is disengaged from said first engaging means; spring means which spring-bias said pawl from said engaging position to said disengaging position; and a user-operated locking element cooperating with said pawl and movable between a locked position in which said locking element locks said pawl in said engaging position, and unlocked position in which said locking element releases said pawl so that under the action of said spring means said pawl is displaced from said engaging position to said disengaging position.

* * * * *